US012760610B2

(12) United States Patent
Hiorth

(10) Patent No.: US 12,760,610 B2
(45) Date of Patent: Oct. 13, 2026

(54) WELL TOOL DEVICE PREVENTING BACKLASH OF RATCHET

(71) Applicant: Interwell Norway AS, Røyneberg (NO)

(72) Inventor: Espen Hiorth, Trondheim (NO)

(73) Assignee: Interwell Norway AS, Røyneberg (NO)

( * ) Notice: Subject to any disclaimer, the term of this patent is extended or adjusted under 35 U.S.C. 154(b) by 0 days.

(21) Appl. No.: 19/133,518

(22) PCT Filed: Jan. 9, 2024

(86) PCT No.: PCT/EP2024/050330
§ 371 (c)(1),
(2) Date: May 28, 2025

(87) PCT Pub. No.: WO2024/153487
PCT Pub. Date: Jul. 25, 2024

(65) Prior Publication Data

US 2026/0201762 A1 Jul. 16, 2026

(30) Foreign Application Priority Data

Jan. 16, 2023 (NO) ..... 20230036

(51) Int. Cl.
*E21B 23/03* (2006.01)

(52) U.S. Cl.
CPC ..... *E21B 23/03* (2013.01)

(58) Field of Classification Search
CPC ..... E21B 23/01; E21B 23/004; E21B 23/03
See application file for complete search history.

(56) References Cited

U.S. PATENT DOCUMENTS 3,282,347 A * 11/1966 Chenoweth ..... E21B 33/136 277/340
3,580,332 A * 5/1971 Dean ..... E21B 23/06 166/151

(Continued)

FOREIGN PATENT DOCUMENTS

GB 2400123 A 10/2004
NO 342097 B1 6/2016

(Continued)

OTHER PUBLICATIONS

International Search Report issued in corresponding International Application No. PCT/EP2024/050330, mailed on Apr. 4, 2024 (4 pages).

(Continued)

*Primary Examiner* — Shane Bomar
(74) *Attorney, Agent, or Firm* — Osha Bergman Watanabe & Burton LLP

(57) ABSTRACT

A well tool device includes a mandrel device; an outer setting sleeve arranged concentric outside of the mandrel device; an anchoring device arranged radially outside the mandrel device; and a ratchet system configured to allow relative longitudinal movement between the mandrel device and the setting sleeve in a first direction and to prevent relative longitudinal movement between the mandrel device and the setting sleeve in a second direction opposite to the first direction. The well tool device is configured to be: in a run state, in which the anchoring device is radially retracted; and, in a first set state, in which the anchoring device is radially expanded. The well tool device is configured to move from the run state to the first set state by relative longitudinal movement between the mandrel device and the setting sleeve. The well tool device has a link system that includes a first actuation sleeve mechanically connected to the outer setting sleeve; a second actuation sleeve mechani- (Continued)

cally connected to the anchoring device; a first arm having a first end and a second end, wherein the first end is pivotably connected to the first actuation sleeve at a first pivoting axis; and a second arm having a first end and a second end, wherein the first end is pivotably connected to the second actuation sleeve at a second pivoting axis; and wherein the second end of the first arm is pivotably connected to the second end of the second arm at a third pivoting axis. A first distance is defined as the radial distance between the third pivoting axis and the first pivoting axis or as the radial distance between the third pivoting axis and the second pivoting axis. The well tool device is configured to be in a second set state, in which the first distance is smaller in the second set state than in the run state and in the first set state.

16 Claims, 7 Drawing Sheets

(56) References Cited

U.S. PATENT DOCUMENTS

| | | | | |
|---|---|---|---|---|
| 2004/0194969 | A1* | 10/2004 | Hiorth | E21B 33/128 166/387 |
| 2005/0000692 | A1 | 1/2005 | Cook et al. | |
| 2014/0374119 | A1 | 12/2014 | Dewars et al. | |
| 2015/0107859 | A1* | 4/2015 | Heggestad | E21B 33/1216 166/243 |
| 2016/0290081 | A1* | 10/2016 | Mlcak | E21B 23/01 |
| 2017/0044865 | A1 | 2/2017 | Sabin et al. | |
| 2017/0234102 | A1 | 8/2017 | Svartvatn et al. | |
| 2017/0370175 | A1* | 12/2017 | Hiorth | E21B 33/134 |
| 2020/0270961 | A1* | 8/2020 | Hiorth | E21B 23/02 |
| 2023/0374883 | A1* | 11/2023 | Hiorth | E21B 33/1208 |
| 2023/0392462 | A1* | 12/2023 | Hiorth | E21B 33/13 |

FOREIGN PATENT DOCUMENTS

| | | | |
|---|---|---|---|
| NO | 339646 | B1 | 8/2016 |
| NO | 343733 | B1 | 5/2019 |
| WO | 2015010813 | A1 | 1/2015 |
| WO | 2016028155 | A1 | 2/2016 |
| WO | 2019194680 | A1 | 10/2019 |
| WO | 2022084128 | A1 | 4/2022 |

OTHER PUBLICATIONS

Written Opinion issued in corresponding International Application No. PCT/EP2024/050330, mailed on Apr. 4, 2024 (10 pages).

Search Report issued in counterpart Norwegian Patent Application No. 20230036 mailed on Jul. 11, 2023 (2 pages).

* cited by examiner

WELL TOOL DEVICE PREVENTING BACKLASH OF RATCHET

FIELD OF THE INVENTION

The present invention relates to a well tool device preventing backlash of ratchet.

BACKGROUND OF THE INVENTION

Many well tools, such as well plugs (bridge plugs, packers, etc.) comprise a sealing device and an anchor device connected circumferentially outside of a mandrel. The plug has a radially retracted, or run, state and a radially expanded, or set, state. In the set state, the anchoring device is in contact with the inner surface of the well pipe, and prevents the plug from moving axially within the well pipe. In the set state, the sealing device is sealing off the annular space between the mandrel of the plug and the inner surface of the well pipe in order to prevent fluid flow between the lower side of the sealing element and the upper side of the sealing element. Examples of such well tools are the Interwell HEX (High EXpansion) plug, the Interwell HPHT (High Pressure High Temperature) plug, the Interwell ME (Medium Expansion) plug.

The sealing device comprises a sealing element designed to retract and expand between its run and set states and must also be designed to withstand a high pressure difference and also to be able to seal the annular area both at lower temperatures and at higher temperatures. In order to do so, the sealing element, typically made from an elastomer, a rubber material etc., must be supported by supporting devices in the set state.

The above plug is typically brought from its run state to its set state by means of a setting tool, which moves a setting sleeve or outer housing in a longitudinal direction relative to the inner mandrel. A ratchet system is typically used to allow relative longitudinal movement between the setting sleeve and the inner mandrel rod in the desired direction, while preventing relative longitudinal movement between the setting sleeve and the inner mandrel rod in the opposite direction.

One disadvantage with the above ratchet system is that a small relative axial movement between the housing and the locking ring is inherently allowed due to the nature of the grooved connections of the ratchet system. This backward movement is often referred to as backlash. Such backlash is undesired, as there is a risk that the well tool will loosen its engagement with the inner surface of the well pipe. Typically, springs are used to prevent or reduce the above backlash. Such springs contributes to the length and complexity of the well tool. As an example, in WO 2015/010813, it is shown a well tool having many springs to prevent or reduce the above backlash.

NO 343733 describes a ratchet system of a well tool device in detail. Here, backlash is also explained in detail.

NO 342097 describes a releasable ratchet system for a well tool device.

As coiled springs only give a relatively small force, cup springs must be used in many such tools to prevent or at least considerably reduce backlash. The cup springs must often be hardened to achieve satisfying material properties, and if the well tool is to be NACE approved (National Association of Corrosion Engineers), only a few materials can be used, such as UNS N07750, UNS R30003, and UNS R30035. These materials are very expensive. For some applications, the well tool device will need a cup spring with a total length of 150-200 mm and will comprise ca 30 cups/discs.

As discussed above, many such well tool devices are relatively long, which contributes to a higher material cost and a higher manufacturing cost (machining, milling etc). Hence, it is an object of the present invention to reduce the length of such well tool devices. A reduction of length will also make the handling of the tools easier, and possibly also the transportation costs may be reduced.

One object of the present invention is to reduce the length of the cup spring and hence to reduce the length and costs for the well tool device.

NO 339646 describes a set force amplifying system which tries to solve at least some of the above problems.

One object of the present invention is to provide an alternative or additional solution to the problems of the backlash of ratchet systems.

SUMMARY OF THE INVENTION

The present invention relates to a well tool device comprising:

- a mandrel device;
- an outer setting sleeve arranged concentric outside of the mandrel device;
- an anchoring device arranged radially outside the mandrel device;
- a ratchet system configured to allow relative longitudinal movement between the mandrel device and the setting sleeve in a first direction and to prevent relative longitudinal movement between the mandrel device and the setting sleeve in a second direction opposite to the first direction;
- wherein the well tool device is configured to be:
- in a run state, in which the anchoring device is radially retracted;
- in a first set state, in which the anchoring device is radially expanded;
- wherein the well tool device is configured to move from the run state to the first set state by relative longitudinal movement between the mandrel device and the setting sleeve;
- characterized in that the well tool device comprises a link system comprising:
- a first actuation sleeve mechanically connected to the outer setting sleeve;
- a second actuation sleeve mechanically connected to the anchoring device;
- a first arm having a first end and a second end, wherein the first end is pivotably connected to the first actuation sleeve at a first pivoting axis;
- a second arm having a first end and a second end, wherein the first end is pivotably connected to the second actuation sleeve at a second pivoting axis;
- wherein the second end of the first arm is pivotably connected to the second end of the second arm at a third pivoting axis;
- wherein a first distance is defined as the radial distance between the third pivoting axis and the first pivoting axis or as the radial distance between the third pivoting axis and the second pivoting axis;
- wherein the well tool device is configured to be in a second set state, in which the first distance is smaller in the second set state than in the run state and in the first set state.

As used herein, the term "radial distance" is the distance measured along an axis being perpendicular to a longitudinal center axis of the well tool device.

In one aspect, the first arm is oriented with an angle relative to the second arm in the run state and in the first set state. The angle between the first arm and the second arm is between 110°-175° in the run state and in the first set state.

In one aspect, the first actuation sleeve is longitudinally displaced from the second actuation sleeve. In one aspect, the first actuation sleeve is connected to the second actuation sleeve via the first and second arms. In one aspect, the first actuation sleeve and the second actuation sleeve are located radially outside of the mandrel device.

In one aspect, the first distance is 0 mm in the second set state. Hence, the angle between the first arm and the second arm is equal to 180° in the second set state. In one aspect, the first distance is slightly negative, for example −0.1 to −1 mm. This means that the angle between the first arm and the second arm slightly more than 180° in the second set state. In this way, the link system is self-locking, i.e. the arms will not accidentally return to their run-state positions should the wedge section be displaced.

In one aspect, the radial distance between the longitudinal center axis and the first pivoting axis is equal to the radial distance between the longitudinal center axis and the second pivoting axis in the run state, in the first set state and in the second set state.

In one aspect, the link system comprises a wedge sleeve comprising a cylindrical section and a wedge section, wherein the cylindrical section is longitudinally aligned with the second ends of the respective first and second arms in the run and first set states and wherein the wedge section is longitudinally aligned with the second ends of the respective first and second arms in the second set state.

In one aspect, the cylindrical section is longitudinally aligned with and engaged with the second ends of the respective first and second arms in the run and first set states and wherein the wedge section is longitudinally aligned with and engaged with the second ends of the respective first and second arms in the second set state. Hence, by moving the wedge sleeve longitudinally, the wedge section will move the second ends in a radial direction, thereby reducing the first distance, thereby bringing the well tool device from its first set state to its second set state.

In one aspect, the wedge sleeve is located radially inside of the first and second arms, wherein the wedge section will move the second ends radially outwardly in order to reduce the first distance.

Alternatively, the wedge sleeve is located radially outside of the first and second arms, wherein the wedge section will move the second ends radially inwardly in order to reduce the first distance.

In one aspect, the mandrel device comprises:

an inner mandrel rod;

an outer mandrel sleeve provided outside of the inner mandrel rod;

a first shear device;

wherein the first shear device is configured to connect the inner mandrel rod to the outer mandrel sleeve in the run state and in the first set state; and wherein the first shear device is configured to be sheared off in the second set state, thereby allowing longitudinal movement of the inner mandrel rod relative to the outer mandrel sleeve.

In one aspect, the well tool device is configured to be brought from the first set state to the second set state by relative axial movement between the inner mandrel rod and the setting sleeve, thereby causing the wedge section of the wedge sleeve to be longitudinally aligned with the second ends of the respective first and second arms.

In one aspect, the link system comprises:

a third actuation sleeve provided radially inside the wedge sleeve and radially outside of the inner mandrel rod;

a second shear device;

wherein the second shear device is configured to connect the wedge sleeve to the third actuation sleeve in the run state and in the first set state; and wherein the second shear device is configured to be sheared off in the second set state, thereby allowing longitudinal movement of the third actuation sleeve relative to the wedge sleeve.

In one aspect, the inner mandrel rod comprises a radial protrusion in its lower end, wherein the radial protrusion has an outer diameter larger than an inner diameter of the third actuation sleeve and smaller than an inner diameter of the wedge sleeve, thereby allowing the radial protrusion to shear off the second shear device by longitudinal movement of the inner mandrel rod.

In one aspect, a second distance between the first actuation sleeve and the second actuation sleeve is larger in the second set state than in the first set state.

In one aspect, the well tool device comprises a spring provided longitudinally between the second actuation sleeve and the anchoring device.

In one aspect, the spring is more compressed in the second set state than in the first set state due to the smaller first distance in the second set state than in the first set state.

In one aspect, an upper end of the well tool device comprises a connection interface for a setting tool, wherein the setting tool is configured to engage an upper end of the mandrel device and an upper end of the outer setting sleeve.

In one aspect, the anchoring device is arranged longitudinally below the outer setting sleeve.

In one aspect, the anchoring device comprises a slips element and an slips supporting element, wherein the slips element is brought from the run state to the first set state by longitudinal movement of the slips supporting element relative to the slips element, wherein the second actuation sleeve is connected to the slips supporting element of the anchoring device.

In one aspect, the well tool device comprises a sealing device provided concentric around the mandrel device; wherein the sealing device is radially retracted in the run state and radially expanded in the first set state, wherein the second actuation sleeve is mechanically connected to the sealing device.

In one aspect, the sealing device comprises a sealing element and a seal supporting element, wherein the sealing element is configured to be brought from the run state to the first set state by longitudinal movement of the seal supporting element relative to the sealing element, wherein the second actuation sleeve is connected to the seal supporting element of the sealing device.

In one aspect, the second actuation sleeve is mechanically connected to the anchoring device via the sealing device.

In one aspect, the mandrel device is configured to be moved longitudinally from an initial position to a first position in order to bring the well tool device from its run state to its first set state.

In one aspect, the inner mandrel rod of the mandrel device is configured to be moved longitudinally to a second position in order to bring the well tool device to its second set state.

In one aspect, the ratchet system is configured to allow relative longitudinal movement between the outer mandrel sleeve of the mandrel device and the setting sleeve in the first direction and to prevent relative longitudinal movement between the outer mandrel sleeve of the mandrel device and the setting sleeve in the second direction opposite of the first direction.

In one aspect, the well tool device comprises a third shear device, wherein the third shear device is configured to connect an upper cylindric sleeve housing and a lower cylindric sleeve housing of the setting sleeve in the run state, the first set state and the second set state;

wherein the third shear device is configured to be sheared off in a retrievable state, in which the anchoring device becomes radially retracted again.

In one aspect, the ratchet system comprises:

a finger connector connected to the setting sleeve, wherein the finger connector is comprising a first, inwardly facing grooved area;

a ratchet ring comprising a second, outwardly facing grooved area and a third, inwardly facing grooved area;

a fourth, outwardly facing grooved area provided on the mandrel device;

wherein the first, inwardly facing grooved area of the finger connector is engaged with the second, outwardly facing grooved area of the ratchet ring;

wherein the third, inwardly facing grooved area of the ratchet ring is engaged with the fourth, outwardly facing grooved area of the mandrel device.

As used herein, the term "groove" may refer to a number of teeth or a number of threads.

The terms "upper", "above", "below" and "lower" are used herein to define parts of the well tool device, when the well tool device is used in a well. "Upper" and "above" refer to a position relatively closer to the well opening and "below" and "lower" refer to a position relatively further away from the well opening. These terms apply both when the well has a vertical and horizontal orientation.

In one aspect, the wedge section is angled with an angle of 5°-45°.

DETAILED DESCRIPTION

Embodiments of the description will now be described in detail with respect to the enclosed drawings, in which.

Figure 1:
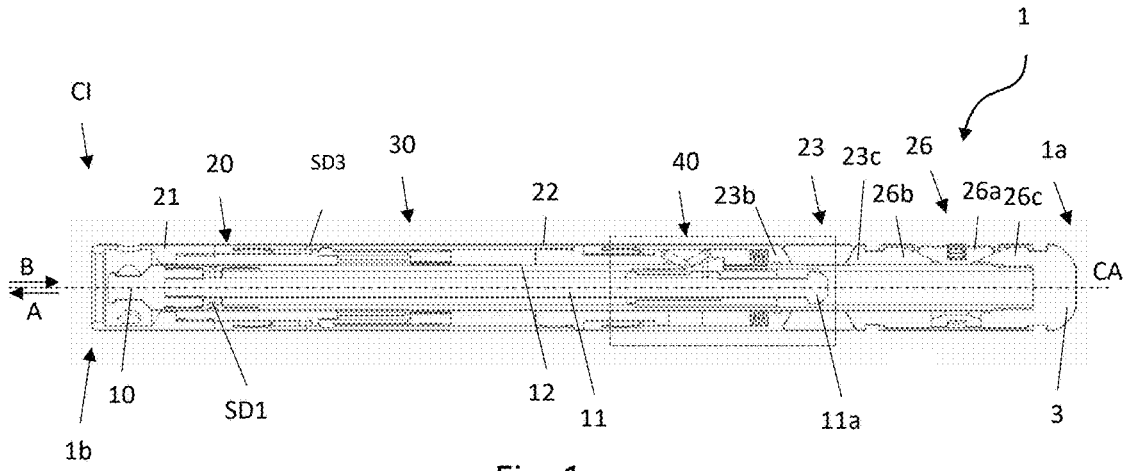
FIG. 1 illustrates a cross sectional view of the well tool in its run state.

It is now referred to FIG. 1. Here it shown a well tool device 1 comprising a mandrel device 10, an outer setting sleeve 20 arranged concentric outside of the mandrel device 10, a sealing device 23 and an anchoring device 26 each arranged radially outside the mandrel device 10.

In addition, the well tool device 1 comprises a ratchet system 30 and a link system 40 (indicated as a dashed box in FIG. 1).

In the drawings, the right side is a lower end 1*a* of the well tool device 1, while the left side is an upper end 1*b* of the well tool device 1. A longitudinal centre axis CA is indicated by a dashed line in FIG. 1.

The well tool device 1 also comprises a connection interface CI provided in the upper end 1*b* of the well tool device 1. The connection interface CI is connectable to a setting tool (not shown) configured to engage an upper end of the mandrel device 10 and an upper end of the outer setting sleeve 20. The well tool device 1 further comprises a nose section 3 provided in the lower end 1*a* of the well tool device 1.

The Mandrel Device

The mandrel device 10 comprises an inner mandrel rod 11 and an outer mandrel sleeve 12 provided outside of the inner mandrel rod 11. The mandrel device 10 further comprises a first shear device SD1 configured to connect the inner mandrel rod 11 to the outer mandrel sleeve 12. The first shear device SD1 is located near the upper end of the inner mandrel rod 11. The setting tool is connectable to the inner mandrel rod 11 of the mandrel device 10.

There is an annular space between the inner mandrel rod 11 and the outer mandrel sleeve 12. In a lower end of the inner mandrel rod 11, a radial protrusion 11*a* is provided.

Figure 5:
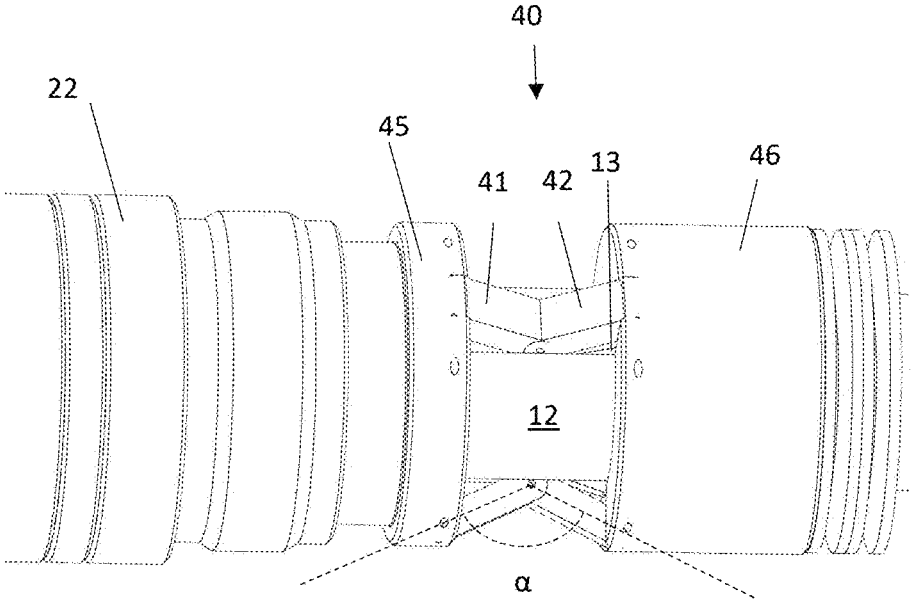
FIG. 5 is a side view of the link system in the first set state.
Figure 8:
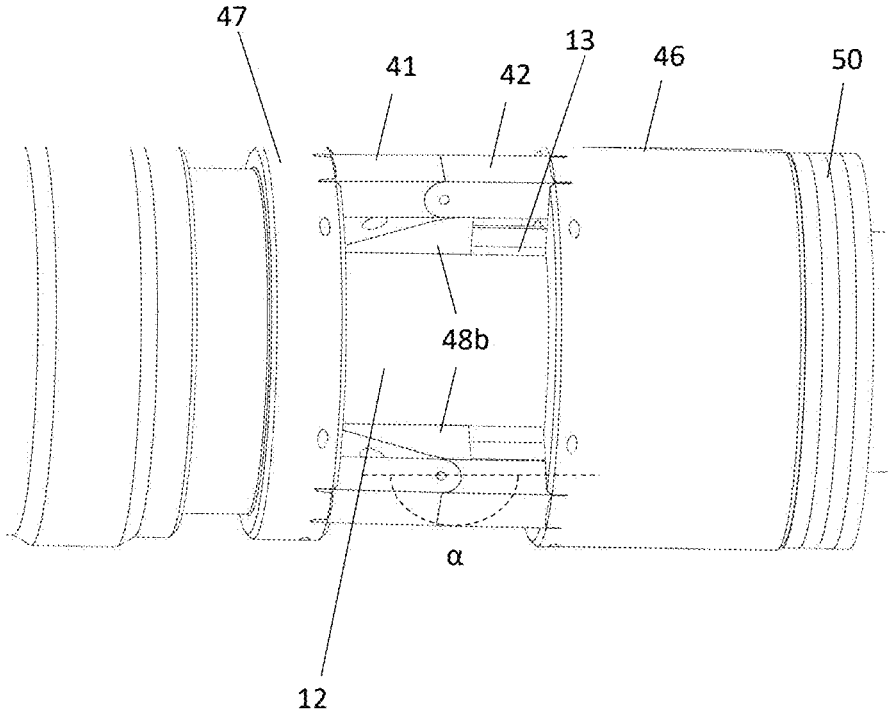
FIG. 8 is a side view of the link system in the second set state.

The outer mandrel sleeve 12 comprises a recess 13, as indicated in FIG. 5 and FIG. 8. In the present embodiment, there are three recesses 13 distributed circumferentially around the outer mandrel sleeve 12.

Figure 9:
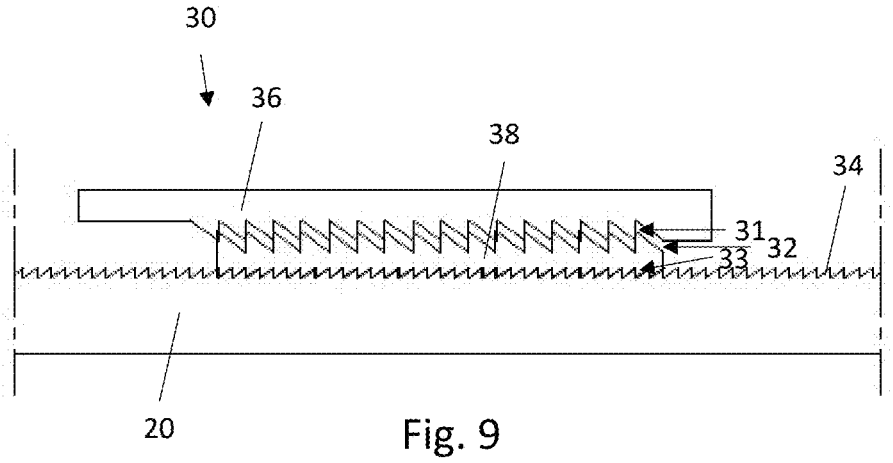
FIG. 9 is an enlarged view of the ratchet system.

The outer mandrel sleeve 12 comprises an outwardly facing grooved area 34, as shown in FIG. 9. Below, this area 34 will be referred to a fourth outwardly facing grooved area 34. The areas 34 may be considered to be a part of the ratchet system 30.

The nose section 3 is secured to the lower end of the outer mandrel sleeve 12.

The Outer Setting Sleeve

The outer setting sleeve 20 comprises an upper cylindric sleeve housing 21 and a lower cylindric sleeve housing 22. The well tool device 1 comprises a third shear device SD3 configured to connect the upper cylindric sleeve housing 21 and the lower cylindric sleeve housing 22 to each other.

The Sealing Device

Figure 2:
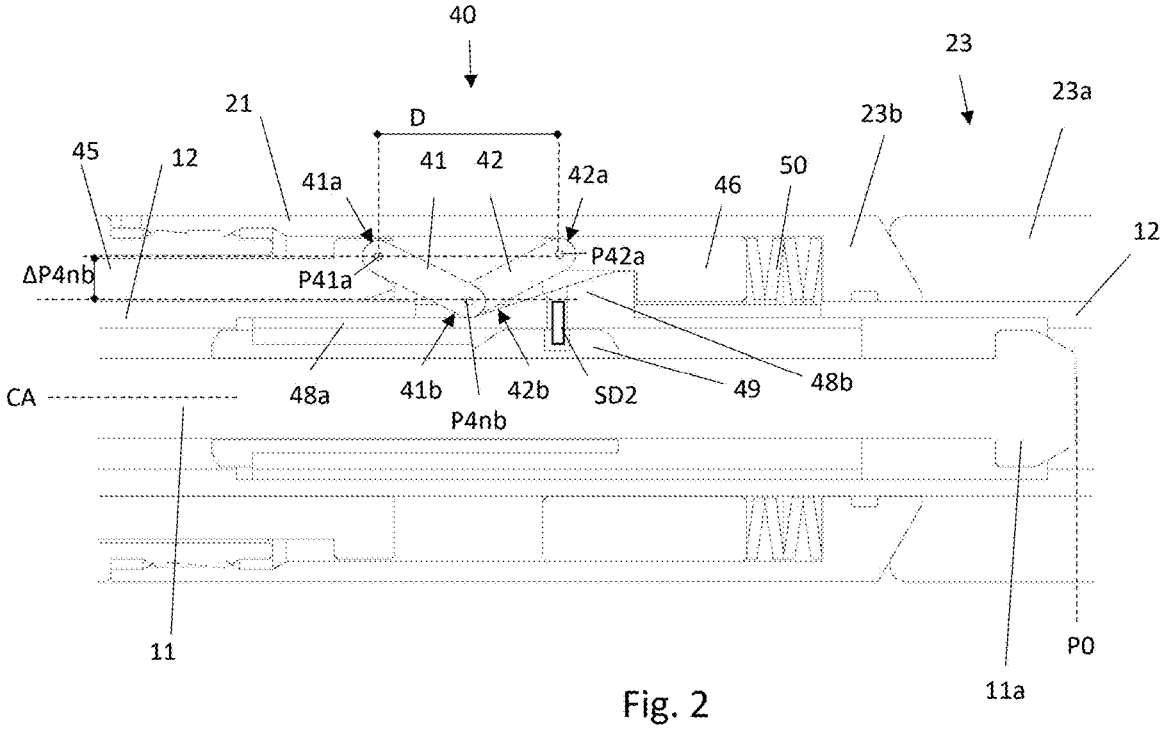
FIG. 2 is an enlarged view of the dashed box of FIG. 1.
Figure 3:
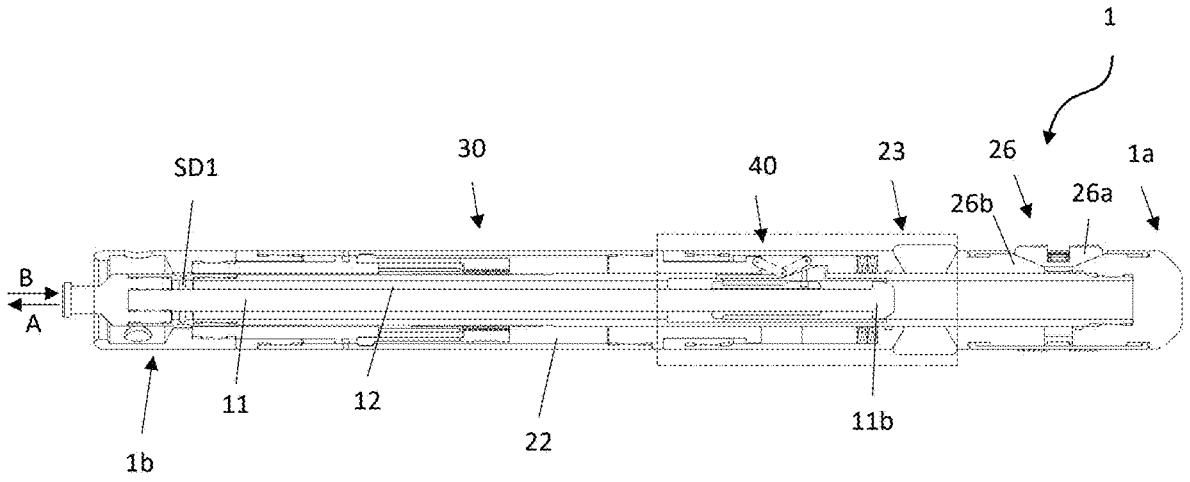
FIG. 3 illustrates a cross sectional view of the well tool in a first set state.

It is now referred to FIG. 1 and FIG. 2. The sealing device 23 is provided radially outside of the outer mandrel sleeve 12 and comprises a sealing element 23*a*, a first seal supporting element 23*b* and a second seal supporting element 23*c*. By relative movement of the first seal supporting element 23*b* and the second seal supporting element 23*c* in the longitudinal direction towards each other, the sealing element 23*a* will expand radially and form a seal towards the inner surface of the well.

In the present embodiment, a lower end of the lower cylindric sleeve housing 22 is forming the first seal supporting element 23*b*.

The sealing device is considered familiar for a person skilled in the art and will not be described further in detail herein.

The Anchoring Device

It is now referred to FIG. 1. The anchoring device 26 is provided radially outside of the outer mandrel sleeve 12 and comprises a slips element 26*a*, a first slips supporting element 26*b* and second slips supporting element 26*c*. By relative movement of the first slips supporting element 26*b* and the second slips supporting element 26*c* in the longitudinal direction towards each other, the sealing element 26*a* will expand radially and form an anchor towards the inner surface of the well. As shown in FIG. 1, the second seal supporting element 23*c* and the first slips supporting element 26*b* may be the same element. Here it is also shown that the second slips supporting element 26*c* is formed by the lower nose section 3.

In the present embodiment, the anchoring device 26 is arranged longitudinally below the outer setting sleeve 20 and longitudinally below the sealing device 23.

The anchoring device is considered familiar for a person skilled in the art and will not be described further in detail herein.

The Ratchet System

It is now referred to FIG. 1 and FIG. 9. Here it is shown that the ratchet system 30 comprises a finger connector 36 connected to the setting sleeve 20, wherein the finger connector 36 is comprising a first, inwardly facing grooved area 31. The ratchet system 30 further comprises a ratchet ring 38 comprising a second, outwardly facing grooved area 32 and a third, inwardly facing grooved area 33.

The first, inwardly facing grooved area 31 of the finger connector 36 is engaged with the second, outwardly facing grooved area 32 of the ratchet ring 38.

The third, inwardly facing grooved area 33 of the ratchet ring 38 is engaged with the fourth, outwardly facing grooved area 34 of the outer mandrel sleeve 12 of the mandrel device 10.

The ratchet system 30 is configured to allow relative longitudinal movement between the outer mandrel sleeve 12 of the mandrel device 10 and the setting sleeve 20 in the first direction A and to prevent relative longitudinal movement between the outer mandrel sleeve 12 of the mandrel device 10 and the setting sleeve 20 in the second direction B opposite of the first direction A.

The finger connector 36 is secured to the inside of the lower sleeve housing 22.

The ratchet system 30 is considered familiar for a person skilled in the art and will not be described further in detail herein.

The Link System

It is now referred to FIG. 2. Here it is shown that the link system 40 comprises a first actuation sleeve 45, a second actuation sleeve 46, a wedge sleeve 48, a first arm 41 and a second arm 42. The first actuation sleeve 45 is connected to the second actuation sleeve 46 via the first and second arms 41, 42. In the present embodiment, there are three pairs of first and second arms 41, 42.

The first actuation sleeve 45 is provided concentric outside of the mandrel sleeve 12 and is mechanically connected to the outer setting sleeve 20. The second actuation sleeve 46 is also provide radially outside of the mandrel sleeve 12 and is mechanically connected to the anchoring device 26. In the present embodiment, the second actuation sleeve 46 is mechanically connected to the anchoring device 26 via the sealing device 23.

The first arm 41 has a first end 41*a* and a second end 41*b*. The second arm 42 has a first end 42*a* and a second end 42*b*. The first end 41*a* is pivotably connected to the first actuation sleeve 45 at a first pivoting axis P41*a*, the first end 42*a* is pivotably connected to the second actuation sleeve 46 at a second pivoting axis P42*a* and the second end 41*b* of the first arm 41 is pivotably connected to the second end 42*b* of the second arm 42 at a third pivoting axis P4*nb*. In this way, the arms ensure that the first actuation sleeve 45 is longitudinally displaced from the second actuation sleeve 46.

As shown in FIG. 2, there is indicated a first distance ΔP4*nb* representing the radial distance between the third pivoting axis P4*nb* and the first pivoting axis P41*a*. As the radial distance between the longitudinal center axis CA and the first pivoting axis P41*a* is equal to the radial distance between the longitudinal center axis CA and the second pivoting axis P42*a*, the first distance ΔP4*nb* is also representing the radial distance between the third pivoting axis P4*nb* and the second pivoting axis P42*a*. Hence, as shown in FIG. 5, the arms are pivoted inwardly towards the longitudinal centre axis CA. In FIG. 5 it is further shown that the second ends of the arms are at least partially guided into the recess 13 of the outer mandrel sleeve 12. In FIG. 5, there is indicated an angle α between the first arm 41 and the second arm 42.

Figure 4:
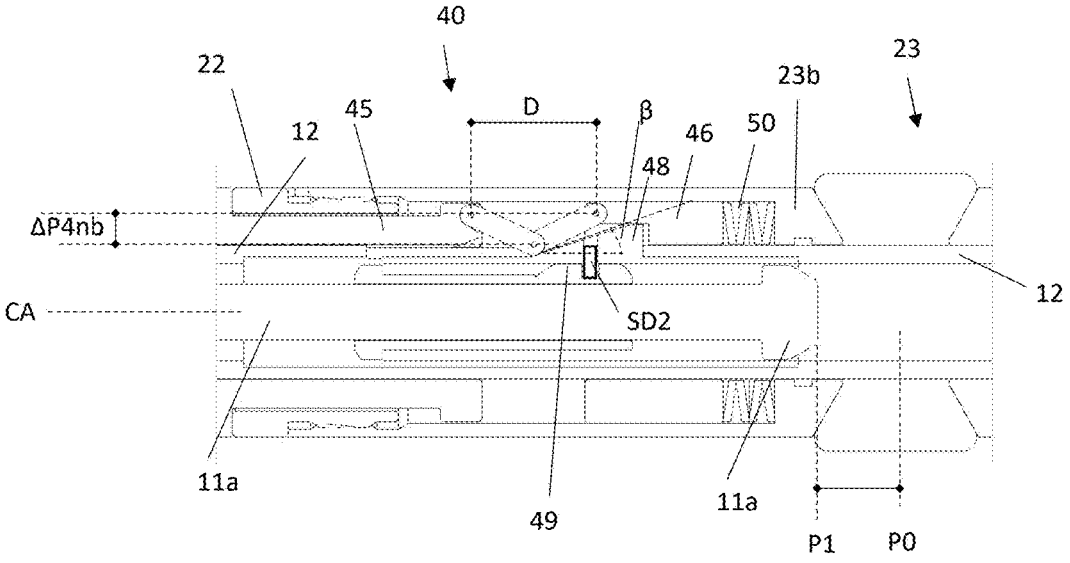
FIG. 4 is an enlarged view of the dashed box of FIG. 2.
Figure 10:
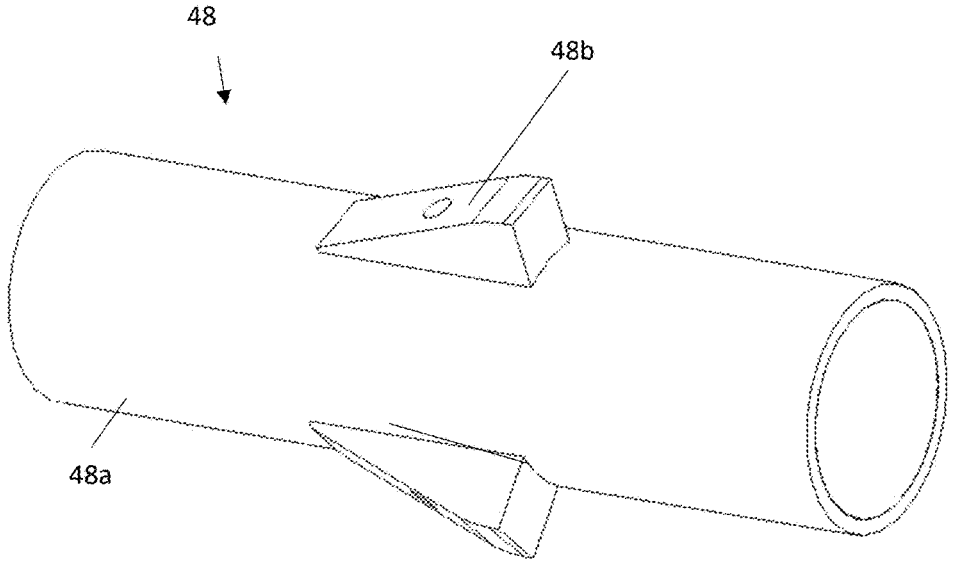
FIG. 10 is a perspective view of the wedge sleeve.

The wedge sleeve 48 is shown in detail in FIG. 10 comprises a cylindrical section 48*a* and a wedge section 48*b*. In FIG. 4, an angle β is indicating the angle of the wedge section 48*b*. The cylindrical section 48*a* is located in the annulus between the inner mandrel rod 11 and the outer mandrel sleeve 12. The wedge section 48*b* is at least partially protruding from the recess 13 of the outer mandrel sleeve 12. The angle β may be 5°-45°. In the present embodiment, the angle β is ca 20°.

The well tool device 1 further comprises a spring device 50 provided longitudinally between the second actuation sleeve 46 and the sealing device 23. Hence, the spring device 50 is also located between the second actuation sleeve 46 and the anchoring device 26.

The link system 40 further comprises a third actuation sleeve 49 provided radially inside the wedge sleeve 48 and radially outside of the inner mandrel rod 11. The well tool device further comprises a second shear device SD2 configured to connect the wedge sleeve 48 to the third actuation sleeve 49 in the run state and in the first set state; and The above-mentioned protrusion 11*a* has an outer diameter larger than an inner diameter of the third actuation sleeve 49 and smaller than an inner diameter of the wedge sleeve 48, thereby allowing the radial protrusion 11*a* to shear off the second shear device SD2 by longitudinal movement of the inner mandrel rod 11.

Operation of the Well Tool Device

The operation of the well tool device 1 will now be described. In FIG. 1, FIG. 2 and FIG. 5, the run state is shown. In this state, the well tool device 1 may be guided to a desired location in the well by means of a setting tool connected to the connection interface CI and a wireline.

Here, the angle α between the first arm 41 and the second arm 42 is 127°. As discussed above, the arms 41, 42 are pivoted into the recess 13 towards the longitudinal centre axis CA. The first distance ΔP4*nb* indicated in FIG. 2 is here ca 11 mm. A second distance D between the first actuation sleeve 45 and the second actuation sleeve 46 is also indicated in FIG. 2. The second distance D is here indicated as the distance between the first pivoting axis P41*a* and the second pivoting axis P42*a*.

It is further shown in FIG. 2 that the cylindrical section 48*a* is longitudinally aligned with the second ends 41*b*, 42*b* of the respective first and second arms 41, 42.

In FIG. 2, an initial position P0 is shown for the lower end of the inner mandrel rod 11.

At the desired location, the well tool device 1 is brought to a first set state as shown in FIG. 2. This is done by pulling the mandrel device 10 upwardly relative to the setting sleeve 20. It should be noted that the first shear device SD1 has not been sheared off yet. Hence, the setting sleeve 20 is moved relative to the outer mandrel sleeve 12, causing the supporting elements 23*b*, 23*c*, 26*a* to be pushed towards the supporting element 26*c* of the nose section 3 and hence radially expand the slips element 26*a* and the sealing element 23*a*.

The lower end of the inner mandrel rod 11 has now moved to a first position P1.

By pulling the mandrel device 10 further upwardly, the first shear device SD1 will be sheared off. The ratchet system 30 will still lock the outer mandrel sleeve 12 to the setting sleeve 20 and hence prevent the anchoring device 26 and the sealing device 23 to return to their radially retracted state again.

Figure 6:
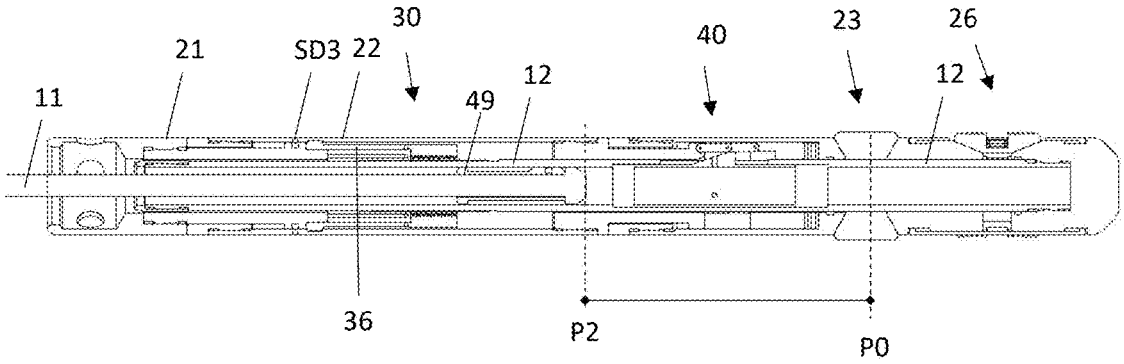
FIG. 6 illustrates a cross sectional view of the well tool in its second set state.
Figure 7:
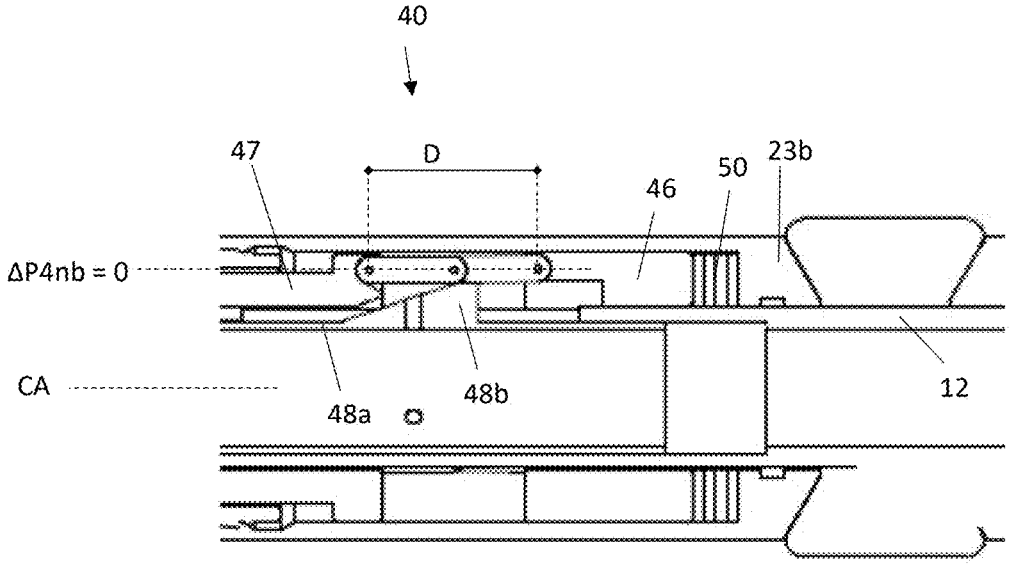
FIG. 7 is an enlarged view of the dashed box of FIG. 4.

In addition, the protrusion 11*a* of the inner mandrel rod 11 will move the third actuation sleeve 49 upwardly. Due to the second shear device SD2, also the wedge sleeve 48 will be moved upwardly. The wedge section 48*b* will now, as shown in FIG. 5, FIG. 6 and FIG. 7 push the second ends 41*b*, 42*b* of the arms 41, 42 radially outwardly.

The first distance ΔP4*nb* is now zero, i.e. the third pivoting axis P4*nb* is aligned with the first and second pivoting axis P41*a* and P42*a*. The second distance D has now increased when compared with the run state, and as shown in FIG. 8, the angle α is 180°. It is also shown that the spring device 50 has been compressed when comparing FIG. 7 with FIG. 4 and FIG. 2.

It should be noted that the first distance ΔP4*nb* may be slightly negative, i.e. that the third pivoting axis P4*nb* is radially outside the first and second pivoting axis P41*a* and P42*a*. In this way, it is achieved that the link system is locked, i.e. it will require a considerable force to return to the first set state or run state should the wedge section 48*b* be displaced away from the area of the third pivoting axis P4*nb*. By pulling the inner mandrel rod 11 further upwards, the second shear device SD2 will be sheared off, as the wedge section 48*b* cannot move longer than allowed by the recess 13 of the outer mandrel sleeve 12, while the third actuating sleeve 49 is allowed to move further up in the annulus between the inner mandrel rod 11 and the outer mandrel sleeve 12, as shown in FIG. 6. The lower end of the inner mandrel rod 11 is now in position P2 and the well tool device 1 is in its second set state.

The shearing of the shear devices SD2 will serve as a confirmation to the operators topside on the different states of the well tool device.

Figure 11:
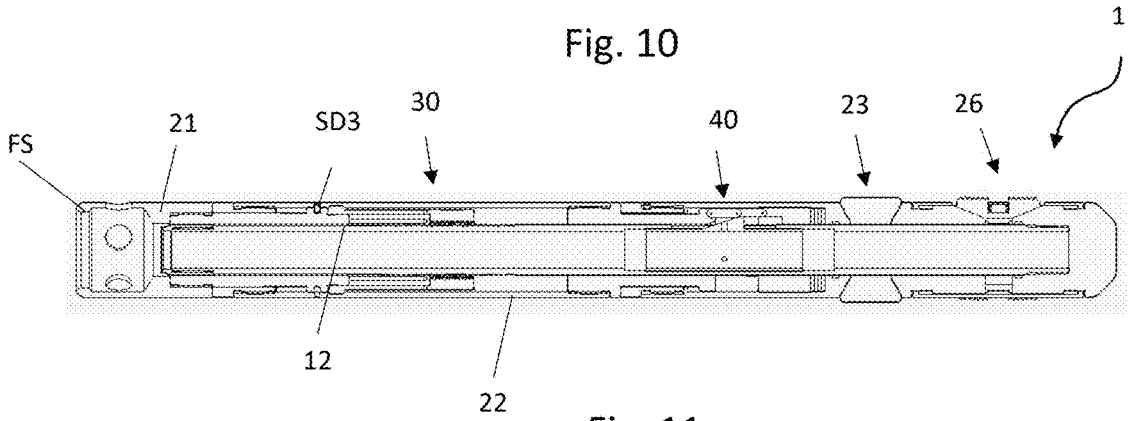
FIG. 11 illustrates a cross sectional view of the well tool when the inner mandrel rod has been pulled up from the well tool device.

The inner mandrel rod 11 and the third actuating sleeve 49 may now be pulled out from the well together with the setting tool. This situation is shown in FIG. 11.

Figure 12:
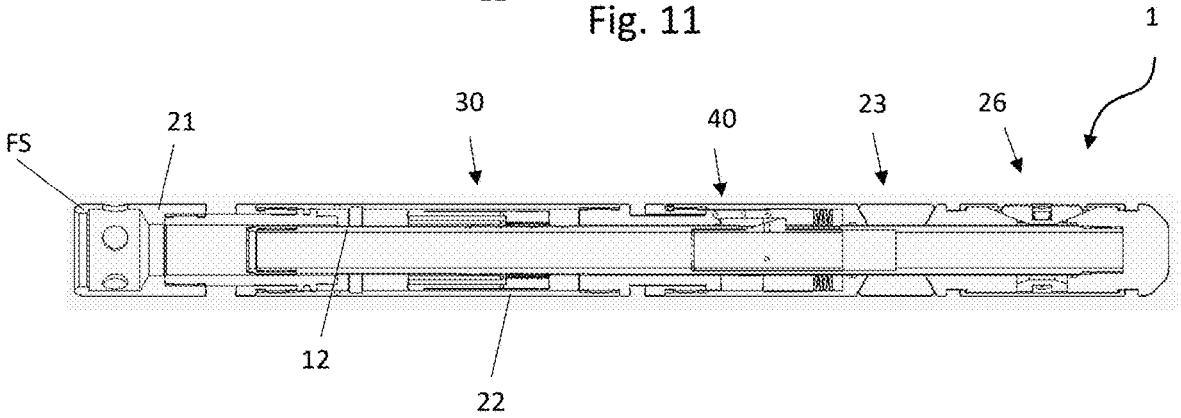
FIG. 12 illustrates a retrievable state in which the well tool device can be retrieved from the well.

The present embodiment is also retrievable, i.e. it has a retrievable state (shown in FIG. 12). Here, a pulling tool in the form of a GS pulling tool (not shown) is lowered into the well and connects to a fishing neck FS provided in the upper end of the upper sleeve housing 21. By pulling the fishing neck FS upwardly, the third shear device SD3 is sheared off, separating the upper sleeve housing 21 from the lower sleeve housing 22. The ratchet system 30 will now be released, allowing the outer mandrel sleeve 12 to move down relative to the lower sleeve housing 22, causing the sealing device 23 and the anchoring device 26 to radially retract. The pulling tool together with the well tool device 1 may now be pulled out from the well. It should be noted that the first distance ΔP4*nb* is 0 mm or slightly negative also in the retrievable state. Hence, in the present embodiment, there is no pivoting of the link system when going from the second set state to the retrievable state.

A prototype of the embodiment described above has been tested and found to fulfil the requirement of ISO14310 Grade VO, i.e. no gas leakage during 5 test periods of 15 minutes each. The temperature was cycled from 130° C. to 30° C. and back to 130° C. The pressure was cycled at 5000 psi from below, above and below at ambient temperature and further from below at low temperature and last pressure cycle at high temperature from below.

The spring device 50 of the prototype comprises 4 cup springs each having a length of 6 mm in uncompressed state. Hence, the total length of the spring device 50 is 24 mm, considerably shorter than the spring devices of some prior art well tools having a length of 200-300 mm in the uncompressed state.

The total length of the prototype was approximately 86 cm, including the ratchet system 30. Hence, a shorter well tool device 1 is achieved.

According to the link system 40, it is achieved that in the second set state, backlash in the ratchet system 30 is prevented. Due to the inclining surface of the wedge sleeve 48 being used to compress the spring device 50, a lower setting force is needed to set the well tool device. Hence, the present well tool device 1 can be set by an electronic setting tool, as an alternative to pyrotechnic setting tools, setting tools with pressure accumulators etc. These alternative setting tools has several disadvantages, such as safety requirements during handling of the setting tools topside.

Alternative Embodiments

In the embodiment described above, the well tool device 1 comprises both a sealing device and an anchoring device.

It should be noted that the link system 40 can be used with other well tool devices as well, for example a well tool device with an anchoring device but without a sealing device.

LIST OF REFERENCE NUMBERS

1 well tool device
1*a* lower end
1*b* upper end
3 nose section
10 mandrel device
11 inner mandrel rod
11*a* radial protrusion
12 outer mandrel sleeve
13 recess
20 setting sleeve
21 upper sleeve housing
22 lower sleeve housing
23 sealing device
23*a* sealing element
23*b* first seal supporting element
23*c* second seal supporting element
26 anchoring device
26*a* slips element
26*b* first slips supporting element
26 second slips supporting element
30 ratchet system
31 first, inwardly facing grooved area
32 second, outwardly facing grooved area
33 third, inwardly facing grooved area
34 fourth, outwardly facing grooved area
36 finger connector
38 ratchet ring
40 link system

41 first arm
41*a* first end of first arm
41*b* second end of first arm
42 second arm
42*a* first end of second arm
42*b* second end of second arm
45 first actuation sleeve
46 second actuation sleeve
48 wedge sleeve
48*a* cylindrical section
48*b* wedge section
50 spring device
60 ratchet mechanism
CA longitudinal center axis
CI connection interface
P0 initial position
P1 first position
P2 second position
P41*a* first pivoting axis
P42*a* second pivoting axis
P4*nb* third pivoting axis
SD1 first shear device
SD2 second shear device
SD3 third shear device
ΔP4*nb* first distance
α angle
β angle

The invention claimed is:

1. A well tool device comprising:
a mandrel device;
an outer setting sleeve arranged concentric outside of the mandrel device;
an anchoring device arranged radially outside the mandrel device;
a ratchet system configured to allow relative longitudinal movement between the mandrel device and the setting sleeve in a first direction and to prevent relative longitudinal movement between the mandrel device and the setting sleeve in a second direction opposite to the first direction;
wherein the well tool device is configured to be:
in a run state, in which the anchoring device is radially retracted;
in a first set state, in which the anchoring device is radially expanded;
wherein the well tool device is configured to move from the run state to the first set state by relative longitudinal movement between the mandrel device and the setting sleeve;
wherein the well tool device comprises a link system comprising:
a first actuation sleeve mechanically connected to the outer setting sleeve;
a second actuation sleeve mechanically connected to the anchoring device;
a first arm having a first end and a second end, wherein the first end is pivotably connected to the first actuation sleeve at a first pivoting axis;
a second arm having a first end and a second end, wherein the first end is pivotably connected to the second actuation sleeve at a second pivoting axis; wherein the second end of the first arm is pivotably connected to the second end of the second arm at a third pivoting axis;
wherein a first distance is defined as the radial distance between the third pivoting axis and the first pivoting axis or as the radial distance between the third pivoting axis and the second pivoting axis;
wherein the well tool device is configured to be in a second set state, in which the first distance is smaller in the second set state than in the run state and in the first set state.

2. The well tool device according to claim 1, wherein in the second set state, the angle between the first arm and the second arm is equal to 180° or slightly more than 180°.

3. The well tool device according to claim 1, wherein the link system comprises a wedge sleeve comprising a cylindrical section and a wedge section, wherein the cylindrical section is longitudinally aligned with the second ends of the respective first and second arms in the run and first set states and wherein the wedge section is longitudinally aligned with the second ends of the respective first and second arms in the second set state.

4. The well tool device according to claim 1, wherein the mandrel device comprises:
an inner mandrel rod;
an outer mandrel sleeve provided outside of the inner mandrel rod;
a first shear device;
wherein the first shear device is configured to connect the inner mandrel rod to the outer mandrel sleeve in the run state and in the first set state; and
wherein the first shear device is configured to be sheared off in the second set state, thereby allowing longitudinal movement of the inner mandrel rod relative to the outer mandrel sleeve.

5. The well tool device according to claim 4,
wherein the link system comprises a wedge sleeve comprising a cylindrical section and a wedge section, wherein the cylindrical section is longitudinally aligned with the second ends of the respective first and second arms in the run and first set states and wherein the wedge section is longitudinally aligned with the second ends of the respective first and second arms in the second set state, and
wherein the well tool device is configured to be brought from the first set state to the second set state by relative axial movement between the inner mandrel rod and the setting sleeve, thereby causing the wedge section of the wedge sleeve to be longitudinally aligned with the second ends of the respective first and second arms.

6. The well tool device according to claim 5, wherein the link system comprises:
a third actuation sleeve provided radially inside the wedge sleeve and radially outside of the inner mandrel rod;
a second shear device;
wherein the second shear device is configured to connect the wedge sleeve to the third actuation sleeve in the run state and in the first set state; and
wherein the second shear device is configured to be sheared off in the second set state, thereby allowing longitudinal movement of the third actuation sleeve relative to the wedge sleeve.

7. The well tool device according to claim 6, wherein the inner mandrel rod comprises a radial protrusion in its lower end, wherein the radial protrusion has an outer diameter larger than an inner diameter of the third actuation sleeve and smaller than an inner diameter of the wedge sleeve, thereby allowing the radial protrusion to shear off the second shear device by longitudinal movement of the inner mandrel rod.

8. The well tool device according to claim 1, wherein a second distance between the first actuation sleeve and the second actuation sleeve is larger in the second set state than in the first set state.

9. The well tool device according to claim 1, wherein the well tool device comprises a spring device provided longitudinally between the second actuation sleeve and the anchoring device.

10. The well tool device according to claim 9, wherein the spring device is more compressed in the second set state than in the first set state due to the smaller first distance in the second set state than in the first set state.

11. The well tool device according to claim 1, wherein an upper end of the well tool device comprises a connection interface for a setting tool, wherein the setting tool is configured to engage an upper end of the mandrel device and an upper end of the outer setting sleeve.

12. The well tool device according to claim 1, wherein the anchoring device is arranged longitudinally below the outer setting sleeve.

13. The well tool device according to claim 1, wherein the anchoring device comprises a slips element and a slips supporting element, wherein the slips element is brought from the run state to the first set state by longitudinal movement of the slips supporting element relative to the slips element, wherein the second actuation sleeve is connected to the slips supporting element of the anchoring device.

14. The well tool device according to claim 1, wherein the well tool device comprises a sealing device provided concentric around the mandrel device; wherein the sealing device is radially retracted in the run state and radially expanded in the first set state, wherein the second actuation sleeve is mechanically connected to the sealing device.

15. The well tool device according to claim 14, wherein the sealing device comprises a sealing element and a seal supporting element, wherein the sealing element is configured to be brought from the run state to the first set state by longitudinal movement of the seal supporting element relative to the sealing element, wherein the second actuation sleeve is connected to the seal supporting element of the sealing device.

16. The well tool device according to claim 14, wherein the second actuation sleeve is mechanically connected to the anchoring device via the sealing device.

* * * * *